United States Patent [19]

Post

[11] Patent Number: 4,680,446

[45] Date of Patent: Jul. 14, 1987

[54] SUPPLEMENTAL ELECTRIC WATER HEATER UNIT FOR COMPENSATING COOLING OF A HOT WATER SUPPLY LINE

[76] Inventor: Steven W. Post, 3310 Redwood Cove, Jonesboro, Ark. 72401

[21] Appl. No.: 782,460

[22] Filed: Oct. 1, 1985

[51] Int. Cl.[4] ..... H05B 1/02; H05B 3/82; F24H 1/20; F24D 17/00

[52] U.S. Cl. ..... 219/312; 122/13 A; 126/362; 137/341; 219/297; 219/306; 219/314

[58] Field of Search ..... 219/314, 310, 312, 316, 219/297, 306, 298; 126/362; 122/13 A, 13 R; 137/341

[56] References Cited

U.S. PATENT DOCUMENTS

| | | | |
|---|---|---|---|
| 1,555,338 | 9/1925 | Vaughan | 219/314 |
| 1,891,926 | 12/1932 | Hall | 126/362 X |
| 2,123,809 | 7/1938 | Seitz | 122/13 R |
| 2,967,666 | 1/1961 | Carlson | 126/362 X |
| 2,969,451 | 1/1961 | Logan | 126/362 X |
| 3,213,850 | 10/1965 | Heeger | 126/362 |
| 3,258,005 | 6/1966 | Grayson | 126/362 |
| 3,285,241 | 11/1966 | Bordeaux | 126/362 |

FOREIGN PATENT DOCUMENTS

| | | | |
|---|---|---|---|
| 668173 | 8/1963 | Canada | 126/362 |
| 366802 | 2/1932 | United Kingdom | 122/13 R |
| 1048551 | 11/1966 | United Kingdom | 219/306 |

*Primary Examiner*—Anthony Bartis

*Attorney, Agent, or Firm*—Warren N. Low; Renee S. Rutkowski

[57] ABSTRACT

A supplemental electric water unit for immediately providing hot water of a desired temperature at a point of use, such a hot water faucet, when the standing line hot water from a remote conventional water heater is of insufficient temperature includes a small insulated tank interposed in the supply line immediately before the point of use. The tank is provided with a thermostatically controlled electric heater for maintaining the water the tank at the desired temperature. An inlet passage directs inflowing water from the supply line to the bottom of the tank and an upper water outlet connects the tank to the point of use. A thermostatic valve in the water inlet passage opens to automatically to bypass inflowing water of proper temperature directly to the top of the tank for discharge through the outlet. However, should the inflowing water be below the proper temperature, the thermostatic valve closes to divert the inflowing water to the bottom of the tank for heating, while the preheated water already present in the tank is delivered through the outlet for use. A pressure responsive check valve in the inflow passage prevents water flow to the tank bottom when the thermostatic valve is open.

16 Claims, 3 Drawing Figures

SUPPLEMENTAL ELECTRIC WATER HEATER UNIT FOR COMPENSATING COOLING OF A HOT WATER SUPPLY LINE

BACKGROUND OF THE INVENTION

The invention herein relates to the art of supplemental or add-on hot water heaters as might be interposed in the supply line between a conventional hot water heater or tank and a utility outlet as a kitchen or basin faucet. In the ordinary installation of hot water piping around the home or in various commercial and industrial locations, there is often an extended length of pipe or supply line between the hot water heater or other reserve supply of hot water and the utility outlet.

While there have been developed, generally speaking, a number of supplemental heating units for the purpose whereby should the principal hot water supply itself be of insufficiently high temperature at the tank due to excess draw or the like, an interposed unit has means to raise the temperature thereof prior to discharge at the faucet or other outlet. Such units as hitherto known for supplementing cool tank water range variably in size from relatively small "under-sink" units to larger installations providing a reserve or supplemental supply of hot water when desired, and quite generally provide heating means, usually an electric heating element, to effect the desired heating of supplemental water notwithstanding previous overdraw of the normally available hot water supply from the main tank or heater.

Illustrative prior art teachings of such units include but are not limited to Morrow U.S. Pat. No. 2,307,061, Ostherheld U.S. Pat. No. 2,377,440, Karlen U.S. Pat. No. 2,870,318, Flanders U.S. Pat. No. 3,952,182, or Fischer 3,381,110.

Such add-on units do not, however, address the problem of the unavoidable cooling of the standing hot water in the length of line between the tank and outlet during non-use of the line between tap utilizations. During such periods, there is no continous and replacement flow of freshly heated water from the tank into the line as it is drawn by the tap.

Efforts to shorten the running length of line, or, to protectively insulate the line length are not always practical or even possible. It is therefore, an object of the invention herein to provide an accommodator unit in general proximity to the outlet or tap which can maintain a relatively small supply of water appropriately heated which is first drawn on faucet usage, and with which the relatively cooled in-line standing water will admix at a remote location from the accomodator outlet to ensure adequate heat at the outlet, prior to arrival thereat of fresh hot water from the main supply as the in-line standing water and the accommodator water are drawn down.

SUMMARY OF THE INVENTION

The instant invention contributes efficiently and economically to solving the problem of cooling of standing hot water in the line between the heater and the utility by the unique provision of an accomodator unit including an interposed heating receptacle provided with check valve inflow means thereto and a thermostat bypass associated therewith whereby if the initial incoming water from the line extending from the heater has become insufficiently hot, the closed thermostat bypass will cause immediate pressure buildup against the check valve to open the same, thereby to deliver the initially available cooler-than-desired water to the bottom of the receptacle through a downflow tube for heating by a heating element or elements. The then-heated water will steadily rise and pass through a conventional outlet port at the top or elsewhere on the receptacle to the utility faucet, while from the outset of the water draw, preheated water in the unit proper will initially flow to the point of use at a satisfactory temperature.

Uniquely, as noted there is provided in the receptacle an aperture communicating with the inflow passage and which is provided with a thermostatic valve permitting bypass of the check valve. At such time as the inflow liquid from the hot water line possesses sufficient heat or normal for a desired usage so as to not require initial draw of the preheated water already present in the accommodator unit, the thermostat will open providing immediate access from the inflow line to the receptacle at the uppermost level thereof, whereby hot water will pass directly and laterally to the outflow conduit and will not be directed through the downflow tube to the lower reaches of the receptacle for pre-heating. Should, however, the inflow water be relatively cool or cooler than desired, the thermostat will not open, and the inflow relatively cool water will unseat the check valve to be directed to the bottom of the accommodator receptacle for admixture with the preexisting hot water therein, and, if necessary, appropriate heating by the thermostatically controlled heating means, while the extant preheated supply will be drawn from the top for immediate use.

Collaterally thereto, the accommodator receptacle is provided with a deflector or baffle internally thereof at the locus of the inflow from the thermostatic valve which serves the purposes of preventing undue agitation or swirling and mixing of inflow water into the receptacle water, and more importantly effects redirection of the properly heated water to the outflow conduit which is laterally disposed with respect thereto, and thereby with minimum disturbance to the heated strata of the water.

A further aspect of the invention resides in the simple and effective construction of the same wherein the accommodator receptacle includes a top panel of substantially planar configuration and which is apertured in these places respectively for the outflow port, the downflow tube, and for the thermostatic valve. Surmounted thereover and suitably sealed thereto as by a gasket, is the control housing of the invention to which the inflow line from the hot water heater is connected and wherein the housing defines a first internal chamber located at the thermostat valve and at the inflow to the check valve, and wherein the housing includes a second chamber communicating between the downstream side of the check valve and the inflow downflow tube to the receptacle. The two chambers and the passage through the check valve define the normal flow path of inflow of unduly cool water from the hot water line into the accommodator receptacle for heating by means therein under substantially conventional thermostatic control.

In a further form of the invention, separate heating elements are provided in the receptacle at differing levels therein so as to effect ready control of heating with minimum draw of current and therefore expense, while still permitting quick and immediate heating as required to desired temperature at the utility faucet when the normal hot water line heater water is not of sufficient temperature.

DESCRIPTION OF THE DRAWINGS

These and other objects of the invention will become apparent from the following specification taken with the accompanying drawings, in which.

DESCRIPTION OF THE INVENTION

Figure 1:
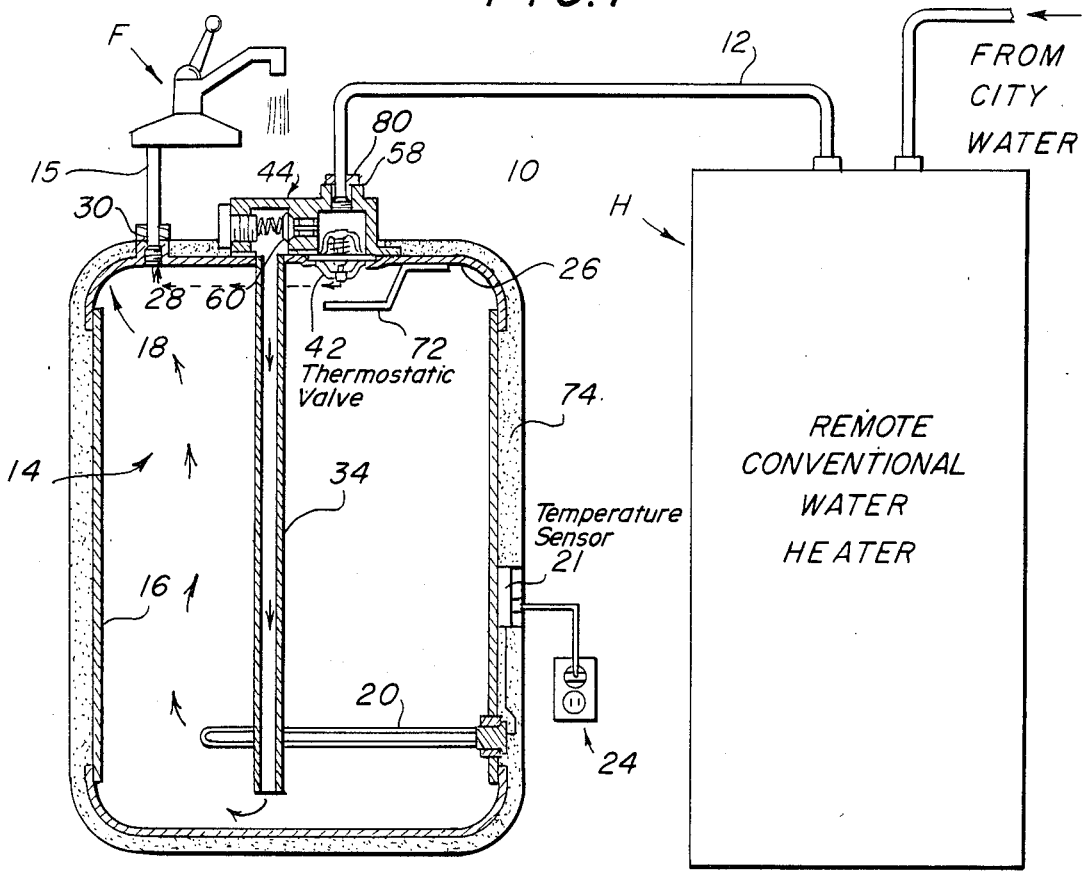
FIG. 1 is an illustrative view of a conventional water heater leading through the accommodator of the invention shown in side elevation to an illustrative view of an utility outlet as a hot water tap.

With reference to the drawings, there is shown at 10 a hot water line accommodator of the present invention interposed between a conventional water heater H and a utility outlet as, for example, a hot water faucet F. Lines 12 and 15 respectively communicate between the heater H and the accommodator 10 and between the accommodator 10 and the faucet F.

In conventional installations, the line 12 from the hot water heater H would normally be connected directly to the line 15 communicating with the hot water faucet F. It will be appreciated that the line 12 may be of substantial length in extending from heater H thereto. As hot water is drawn from the tap or the like at F for diverse purposes whether residental, commercial, or industrial, initial flow therefrom at any given time may deliver standingline water which has cooled markedly from the temperature of normal outflow water from the heater, and wherein the line 12 will have to be substantially exhausted before the same is filled by fresh heater flow at the intended temperature. In this event, the outputted water as initially delivered at the faucet is of necessarily lower or insufficient temperature at the onset of the draw for intended purposes of washing, sterilization, etc.

To this end, the accommodator unit 10 of the invention is provided which is interposed as observed in the lines 12, 15 from the heater H to the faucet F, and preferably proximate to faucet F to minimize line length therefrom. The same is suitably controlled so that should the standing line water be of insufficient temperature, water of a proper or suitable temperature will be substantially immediately provided on demand in the accommodator unit for delivery to the faucet until fresh flow from heater H can pass the length of the line 12.

Figure 2:
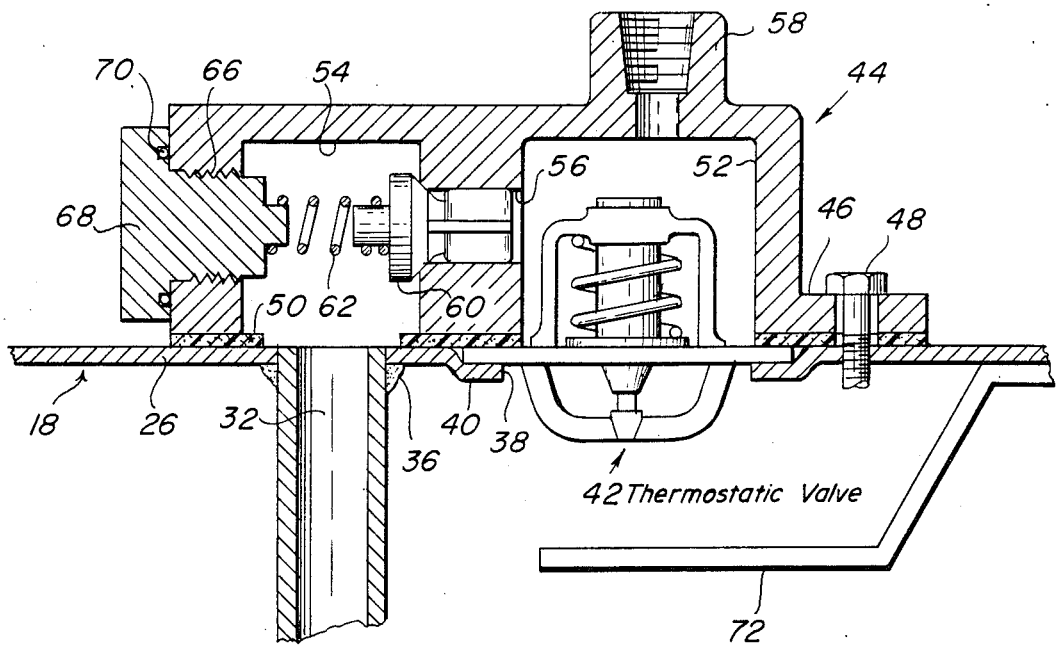
FIG. 2 is a detail view, partly fragmentary, of the upper portion of the accommodator receptacle and the inflow housing therefor.
Figure 3:
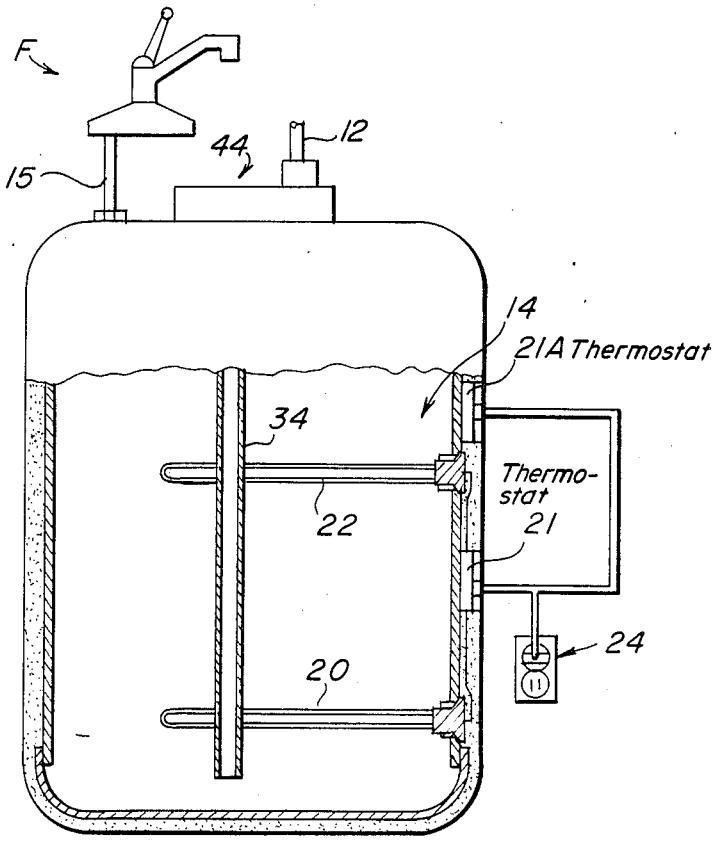
FIG. 3 is a side section illustrating an accommodator unit similar to that of FIG. 1 but further including a second heater element.

As seen in FIG. 1 and in greater detail in the fragmentary view of FIG. 2, the accommodator unit includes a primary receptacle or tank 14 of suitable material, as sheet metal such as stainless steel, which includes a lower body portion 16 and an upper closure 18 welded or otherwise secured thereto at the time of assembly. The lower body portion 16 may be conventionally apertured to receive in appropriate leakproof relation heating means such as electric heater element 20 seen in FIG. 1, or dual heater elements 20, 22 as seen in FIG. 3. The heating element as at 20 is provided with a conventional thermostatic control as at 21 and is associated with an electrical supply of usual nature incated at 24 thereby to effect desired heating of the water to a predetermined temperature which may be preset or adjustable in known manner.

The closure 18 includes an upper planar portion 26 which is provided with an aperture or port at 28 and a conventional leakproof fitting 30 thereby to secure the conduit 15 thereto so that hot water may flow from the receptacle 14.

The planar cover portion 26 is additionally apertured at 32 to provide a leakproof mounting, as by welding, for the downflow tube 34, such weld being illustratively shown at 36 in FIG. 2. Finally, the closure is provided with an aperture at 38 which conveniently may include a depressed seating flange 40 for reception of the thermostat valve 42 thereon. Mounted in a suitable manner, as by spot welding a deflector or baffle 72 is secured beneath cover 18 in position to intercept and laterally deflect flow through valve 42.

The receptacle 14 includes surmounted thereon an inflow connection housing 44 which may conveniently be a metal or plastic casting and which is suitably shaped and machined to provide mounting means as illustratively shown by the flange 46, wherein bolt 48 secures the housing flange to the receptacle 14 in an appropriate leakproof manner. Obviously, additional flange areas and securing bolts are provided about the periphery of housing 44, and in usual manner, seal means as gasket 50 may be interposed between the housing and the closure 18 to insure the leakproof relation.

The housing 44 is formed with two chambers 52 and 54 which communicate by means of bore 56 therebetween. An inlet port 58 is provided in housing 44 to the chamber 52, the inlet port 58 receiving therein the hot water infeed line 12 by means of a suitable conventional coupling generally indicated at 80 (FIG. 1).

The chamber 52 of housing 44 is so positioned as to overlie the aperture 38 in the receptacle and embrace the thermostatic valve 42 thereat. The valve is fixedly secured in place as by being clamped between the housing 44 and the cover portion 26.

The other housing chamber 54 overlies the downflow tube 34 and communicates freely therewith. Disposed in the bore 56 between the two chambers is check valve 60 which is maintained in normally sealing relation to the housing about the periphery of the bore 56 by means of a light compression spring 62. The check valve 60 precludes flow from chamber 52 into chamber 54 and thence into the downflow tube in the absence of a modest positive pressure in chamber 52 as will be set forth more fully hereinafter.

Housing 44 is also provided with a threaded aperture at 66 to receive a closure such as threaded plug 68 provided with conventional seal means as O-ring 70, thereby to provide ready access to the spring 62 and the check valve 60 upon removal of the plug 68 aligned therewith.

Accordingly, in operation, hot water normally flows from line 12 into the housing 44 through the fitting at 58 and thence into chamber 52. If, however, the water is of insufficient temperature, say below 130° F. or other predetermined temperature of the thermostat due to prolonged standing and heat loss in line 12, the thermostatic valve 42 will be closed and the infed water may not pass therethrough into receptacle 14. Accordingly, extant water pressure, which need only be of slight amount on the order of 2 pounds, will unseat valve 60 by shifting the same to the left against the force of spring 62 and thereby permit the relatively cooler water to pass through the bore 56 and into the chamber 54.

Thus, chamber 52, bore 56, and chamber 54 form a first branch flow path through the housing 44 when the hot water is relatively cooler than desired, and upon so doing the cooler water will be led into downflow tube 34 to emerge into receptacle 14 at the bottom thereof proximate to heater element 20. In so doing, it will be seen that extant hot water in accommodator unit 10 will be drawn from the tap through discharge connection 28, while the cooler water from line 12 is admixed with the hotter water in unit 10 near the bottom.

Accordingly, the water in receptacle 14 will be heated to and maintained at the predetermined temperature established by the heating element 20 which would be the normal or desired hot water temperature at the point of utility, as at faucet F, and the hot water will be in open flow from line 12, the flow path 52, 56, 54, downflow tube 34 and then upwardly as heated through the tank and out through aperture 28 into the faucet conduit 15, until inflow hot water from line 12 becomes sufficiently hot.

When, however, excessive hot water draw has not occurred and the standing water in line 12 is at the desired temperature, upon reaching chamber 52 and housing 44, the properly heated water will be sufficient to unseat the thermostatic valve 42 and permit the hot water to pass directly into the upper portion of receptacle 14 through aperture 38 thereat forming a second flow branch. As a consequence, there will be no overpressure applied to the check valve 60 and the same will remain seated, whereby properly hot water will not be unnecessarily directed through the flow path and down downflow tube 34.

Rather, the hot water will pass directly into receptacle 14 as noted through thermostatic valve 42, and will be deflected by baffle or deflector plate 72 generally laterally directly toward the faucet outlet port at 28 through the upper portion of the receptacle without undue disturbance of the lower levels of water in the receptacle 14.

At all times irrespective of the condition of hot water in the extended length of line 12, the supply of water present in receptacle 14 will be held at a desired temperature by virture of the thermostatic control of electric heater element 20. When the infed hot water from line 12 is of ample temperature, the virtually direct flow from the infeed line 12 laterally to the faucet conduit 15 insures the shortest flow path with minimum heat loss or other disturbance, while if at any time the flow of previously standing water from the line 12 should be insufficiently hot, the cooler temperature arriving into chamber 52 of housing 44 will then effect prompt closure of the thermostatic valve 42 causing diversion of the cooler water as set forth through the flow-unseated valve 60 and then into the downflow tube for heating by the thermostatic element 20 prior to delivery to faucet F, while the pre-heated receptacle water at the top insures adequate initial hot flow to the faucet.

In a modified form of the invention as seen in FIG. 3 the receptacle 14 is provided with a second upper heating element 22 and temperature sensor 21A which shares the heating load with the lower element 20. The provision of the upper element 22 assures that the upper portion of receptacle 14 there will at all times be a sufficiently heated supply of water for immediate delivery through the outlet aperture 28 to the utility device, and permits faster heating of the water.

Typically, a operating temperature intended for household water might be 140° F. and the thermostat control 21 in receptacle 14 whether a single or double heater element is employed, would be utilized to maintain such a temperature.

The receptacle 14 of sheet metal or the like may be provided with such mounting flanges as may be desired for convenient assembly or clamp securement in the conduit system between the hot water and the faucet, and to maximize efficiency would preferably be provided with a suitable exterior insulation layer 74 for maximum energy economy. Other means conventional in the art to minimize corrosion, electrolytic action and the like may also be associated with the receptacle to enhance its service life.

In like manner, while in the preferred embodiments of the invention as disclosed, simple and highly effective means as the low pressure spring check valve 60 and the thermostatic valve 44 have been disclosed, obviously the principles of the invention may be adapted for utilization with other forms of valve controlled assemblies as by a solenoid-controlled valve responsive to a temperature transducer, ball float valves, or indeed manual control upon observation by the user without departing from the spirit and the scope of the invention herein.

What is claimed is:

1. A hot water line accomodator for interposition between a hot water supply and a utility tap thereby to provide immediate hot water in the event of excess heat loss in the supply line, comprising, a receptacle for receiving input water and discharging heated water therefrom, said receptacle having an inflow connection adapted to be connected to a hot water supply to receive hot water therefrom and a discharge connection adapted to be connected to a utility tap at the upper portion thereof, electric heating means carried by the receptacle for heating water therein when energized, means providing electric connections for said heating means, means providing thermostatic control of said electric heating means in response to temperature of water in said receptacle, a downflow tube extending from a point adjacent said inflow connection to a point adjacent the bottom of said receptacle, means defining a flow path between said inflow connection and said downflow tube, a normally closed, pressure responsive, check valve mounted in said flow path, said valve opening upon occurrence of a predetermined minimum inflow water pressure from said inflow connection, a thermostatic valve disposed in a flow passage between said flow path and the upper portion of said receptacle controlling flow between said flow path and the upper portion of said receptacle in bypass relation to said downflow tube, said thermostatic valve opening in response to a predetermined minimum inflow water temperature, thereby to admit sufficiently hot water directly to the upper portion of said receptacle through said flow passage for direct flow to said discharge connection, wherein opening of said thermostatic valve relieves pressure on said check valve permitting closing thereof whereupon flow through said downflow tube toward the lower portion of said receptacle is prevented when inflow water temperature is above said predetermined minimum temperature.

2. The hot water line accomodator of claim 1 wherein said electric heating means is an immersible electric heating element mounted within said receptacle.

3. The hot water line accomodator of claim 1 wherein said electric heating means comprises a pair of electric heater elements vertically spaced in said receptacle, and further including a separate thermostat control for each said heating element.

4. The hot water line accomodator of claim 1 further including a deflector disposed in said receptacle beneath said flow passage thereby to distribute water flow therethrough into said receptacle upper portion without undue turbulence.

5. The hot water line accomodator of claim 4 wherein said deflector is positioned to direct inflow water laterally toward said outflow connection, thereby to maximize hot water delivery thereto without undesirable agitation of standing water in said receptacle.

6. The hot water line accomodator of claim 1 wherein said check valve has an operating value on the order of 2 psi and said thermostatic valve has an operating value on the order of 130° F. for said inflow water.

7. The hot water line accomodator of claim 1 wherein said receptacle includes a top wall at the upper portion thereof having a substantially planar portion, and said planar portion is apertured to receive said downflow tube and said flow passage, and said thermostatic valve is disposed therein.

8. The hot water line accomodator of claim 7 including a housing surmounted on said receptacle top wall, said housing having therein said inlet port, said flow path, and said check valve, said housing further having aperture means for receiving said thermostatic valve, said means being aligned with the corresponding aperture on said receptacle.

9. The hot water line accomodator of claim 8 wherein said housing is detachably secured to said receptacle.

10. The hot water line accomodator of claim 8 wherein said flow path in said housing includes a first chamber adjacent said inflow connection and having therein said thermostatic valve, a second chamber communicating with said downflow tube, and a bore interconnecting said chambers.

11. The hot water line accomodator of claim 10 wherein said check valve is disposed in said second chamber and effects a yieldable seal with respect to said bore.

12. The hot water line accomodator of claim 10 further including a selectively operable access port in said housing for said check valve.

13. The hot water line accomodator of claim 1 further including an insulating covering on said receptacle.

14. A hot water line accomodator for interposition between a hot water supply and a utility tap in proximity to the latter thereby to provide immediate hot water as needed, irrespective of standing line water temperature from the heater, comprising, a receptacle for receiving line water and discharging heated water therefrom, said receptacle having an inflow connection adapted to be connected to a hot water supply to receive hot water therefrom and a discharge connection adapted to be connected to a utility tap at the upper portion thereof, heating means for heating water in said receptacle, means controlling said heating means in response to temperature of water in said receptacle, means for directing water downwardly toward the bottom of said receptacle from a point adjacent said inflow connection, means defining a flow path between said inflow connection and said downward directing means a normally closed, pressure responsive check valve mounted in said flow path, said valve opening upon occurrence of a predetermined minimum inflow water pressure from said inflow connection, a thermostatic valve disposed in a flow passage between said flow path and said receptacle at the upper portion thereof for controlling flow between said flow path and said receptacle upper portion in bypass relation to said downward water flow directing means, said thermostatic valve opening in response to a predetermined minimum inflow water temperature, thereby to admit water directly to the upper portion of said receptacle through said flow passage for flow toward said discharge connection, wherein opening of said thermostatic valve relieves pressure on said check valve permitting closing thereof whereupon flow through said downward directing means toward the bottom of said receptacle is prevented when inflow water temperature is above said predetermined minimum temperature.

15. A hot water line accomodator for interposition between a hot water supply and a utility tap in proximity to the latter thereby to provide immediate hot water as needed, irrespective of standing line water temperature from the heater, comprising, a receptacle for receiving line water and discharging heated water therefrom, said receptacle having an inflow connection adapted to be connected to a hot water supply to receive hot water therefrom and a discharge connection adapted to be connected to a utility tap at the upper portion thereof, heating means for heating water in said receptacle, means controlling said heating means in response to temperature of water in said receptacle, means for directing inflowing water downwardly toward the bottom of said receptacle from a point adjacent said inflow connection, a thermostatic valve responsive to the temperature of the inflowing water mounted in a flow passage between the upper portion of said receptacle and said inflow connection for selectively controlling flow of inflowing water between said downward directing means and said receptacle upper portion through said water flow passage in bypass relation to said downward directing means, means for terminating flow of inflow water through said downward directing means in response to the opening of said thermostatic valve, said thermostatic valve opening in response to a predetermined minimum inflow water temperature, thereby to admit inflowing water directly to the upper portion of said receptacle through said flow passage for flow toward said discharge connection and thereby bypass flow to said downward directing means.

16. A hot water line accomodator for interposition between a hot water supply and a utility tap in proximity to the latter thereby to provide immediate hot water as needed, irrespective of standing line water temperature from the heater, comprising, a receptacle for receiving line water and discharging heated water therefrom, said receptacle having a discharge connection at the upper portion thereof adapted to be connected to a utility tap, heating means for heating water in said receptacle, means controlling said heating means in response to the temperature of water in said receptacle, an inflow connection on said receptacle adapted to be connected to a hot water supply and having a thermostatic valve associated therewith, said inflow connection having a first branch for directing water to the bottom portion of the receptacle and a second branch directing water to the upper portion of the receptacle, said inflow connection having means cooperating with said thermostatic valve to close said second branch in response to incoming water below a predetermined temperature and direct the water through said first branch toward the bottom of said receptacle, and to close said first branch in response to water above a predetermined water temperature and direct the water through said second branch into the top of said receptacle, whereby relatively cooler water will be heated by said heating means before exiting said discharge connection and relatively hotter water is enabled to pass directly to said discharge connection.

* * * * *